US007079094B2

(12) United States Patent
Tokioka et al.

(10) Patent No.: US 7,079,094 B2
(45) Date of Patent: Jul. 18, 2006

(54) CURRENT SUPPLY CIRCUIT AND DISPLAY APPARATUS INCLUDING THE SAME

(75) Inventors: Hidetada Tokioka, Hyogo (JP); Ryuichi Hashido, Hyogo (JP); Takahiro Urakabe, Hyogo (JP); Masafumi Agari, Hyogo (JP); Masashi Okabe, Hyogo (JP); Mitsuo Inoue, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 406 days.

(21) Appl. No.: 10/601,876

(22) Filed: Jun. 24, 2003

(65) Prior Publication Data

US 2004/0036457 A1 Feb. 26, 2004

(30) Foreign Application Priority Data

Jun. 24, 2002 (JP) ..... 2002-182868

(51) Int. Cl.
*G09G 3/32* (2006.01)

(52) U.S. Cl. ..... 345/82; 345/76

(58) Field of Classification Search ..... 345/76, 345/77, 82, 83, 204, 205; 315/169.3
See application file for complete search history.

(56) References Cited

U.S. PATENT DOCUMENTS

| | | | | |
|---|---|---|---|---|
| 5,719,589 | A * | 2/1998 | Norman et al. | 345/82 |
| 6,169,528 | B1 * | 1/2001 | Oguchi et al. | 345/74.1 |
| 6,351,255 | B1 * | 2/2002 | Ishizuka et al. | 345/77 |
| 6,369,786 | B1 * | 4/2002 | Suzuki | 345/77 |
| 6,414,661 | B1 * | 7/2002 | Shen et al. | 345/82 |
| 6,707,438 | B1 * | 3/2004 | Ishizuka et al. | 345/78 |
| 6,747,617 | B1 * | 6/2004 | Kawashima | 345/76 |
| 6,943,761 | B1 * | 9/2005 | Everitt | 345/82 |
| 2004/0061670 | A1 * | 4/2004 | Muruyama et al. | 345/76 |

OTHER PUBLICATIONS

*Akira Yumoto et al., "Pixel-Driving Methods for Large-Sized Poly-Si AM-OLED Displays," Asia Display/IDW 2001, pp. 1395-1398.

* cited by examiner

*Primary Examiner*—Xiao Wu
(74) *Attorney, Agent, or Firm*—Buchanan Ingersoll PC

(57) ABSTRACT

In a compensation mode executed before a supply mode, a current supply circuit for supplying a data current according to display luminance to a current-driven light emitting device allows a reference current to pass through a drive transistor for supplying the data current to a data line in the supply mode. The voltage of a node connected to the gate of the drive transistor at this time is held by a voltage holding capacitor. In the supply mode, the voltage of the node changes according to a data voltage. The data voltage is set according to the difference between the data current to be supplied and the reference current.

14 Claims, 10 Drawing Sheets

CURRENT SUPPLY CIRCUIT AND DISPLAY APPARATUS INCLUDING THE SAME

BACKGROUND OF THE INVENTION

1. Field of the Invention

The present invention relates to a current supply circuit and, more particularly, to a current supply circuit for supplying a current according to display luminance instructed to a current-driven light emitting element, and an electroluminescence (EL) display apparatus having the same.

2. Description of the Background Art

In recent years, in the field of a flat panel display in which a liquid crystal display is typically used, attention is being paid to an organic EL display. The organic EL display has advantages of higher contrast ratio, higher response, and wider angle of visibility as compared with a liquid crystal display. In the organic EL display, an organic EL element as a current-driven light emitting element is arranged for each pixel. A representative example of the organic EL element is an organic light emitting diode.

Particularly, in recent years, among such organic EL displays, from the viewpoints of higher definition of an image and lower power consumption, attention is being paid to a low-temperature polysilicon TFT display using, as a drive device of an organic light emitting diode, a thin film transistor (TFT) using low-temperature polysilicon. However, manufacture variation of transistor characteristics such as mobility and threshold voltage of the low-temperature polysilicon TFT tends to be relatively large as compared with that of a conventional TFT.

In such a background, a problem of non-uniformity of a display luminance characteristic of pixels, that is, variation in display luminance has been pointed out as one of the problems of the organic EL display. As a configuration for solving the problem, a configuration of a so-called "current-programmed pixel circuit" is disclosed in "Pixel-Driving Methods for Large-Sized Poly-Si AM-OLED Displays", Akira Yumoto et al., Asia Display/IDW'01(2001), pp. 1395–1398.

FIG. 11 is a circuit diagram for describing the configuration of a current-programmed pixel circuit according to a conventional technique.

Referring to FIG. 11, a current-programmed pixel circuit of a conventional technique includes a pixel driving circuit PDC for supplying a current corresponding to instructed display luminance to an organic light emitting diode OLED provided as a light emitting element. Pixel driving circuit PDC has n-type (n-channel) TFT elements T1 and T4, p-type (p-channel) TFT elements T2 and T3, and a voltage holding capacitor Ca.

Although the details are not shown, in the whole organic EL display, pixel circuits shown in FIG. 11 are arranged in a matrix. Each pixel is associated with one scan line SL and one data line DL. Scan line SL is activated to the high level (hereinafter, also written as "H level") in correspondence with a scan period of a corresponding pixel circuit and is inactivated to the low level (hereinafter, also written as "L level") in the other period. To data line DL, a data current Idat corresponding to display luminance of the pixel circuit to be scanned is passed.

N-type TFT element T1 is electrically coupled between corresponding data line DL and a node Na and its gate is coupled to corresponding scan line SL. p-type TFT elements T2 and T3 are connected in series between a power source voltage Vdd and organic light emitting diode OLED. N-type TFT element T4 is electrically coupled between a connection node of p-type TFT elements T2 and T3 and node Na. The gate of p-type TFT element T2 is connected to node Na and each of the gates of p-type TFT element T3 and n-type TFT element T4 is coupled to corresponding scan line SL. The voltage of node Na, that is, a gate-source voltage (hereinafter, also simply referred to as "gate voltage") of p-type TFT element T2 is held by voltage holding capacitor Ca connected between node Na and power source voltage Vdd.

Organic light emitting diode OLED is connected between p-type TFT element T3 and a common electrode. FIG. 11 shows a "cathode common configuration" in which the cathode of organic light emitting diode OLED is connected to the common electrode. To the common electrode, a predetermined voltage Vss is supplied. As predetermined voltage Vss, a ground voltage or a negative voltage is used.

The configuration of a current supply circuit for generating data current Idat corresponding to display luminance will now be described.

FIG. 12 is a circuit diagram showing the configuration of a current supply circuit according to a conventional technique for supplying data current Idat to a current-programmed pixel circuit.

Referring to FIG. 12, the current supply circuit according to a conventional technique has n-type TFT elements T5 to T8 and a voltage holding capacitor Cb. N-type TFT elements T5 and T6 are connected in series between data line DL and predetermined voltage Vss. N-type TFT element T7 is electrically coupled between a node to which data voltage Vdat corresponding to instructed display luminance is transmitted and a node Nm. N-type TFT element T8 is electrically coupled between a node Nb and node Nm. Node Nm corresponds to a connection node of n-type TFT elements T5 and T6.

Voltage holding capacitor Cb is connected between node Nb and predetermined voltage Vss. The gate of n-type TFT element T6 is connected to node Nb. To the gate of n-type TFT element T5, a control signal Sscn is inputted. To the gate of each of n-type TFT elements T7 and T8, a control signal Sadj is inputted.

The operation of the current supply circuit of the conventional technique will now be described.

First, in an operation mode in which control signal Sscn is set to the L level and control signal Sadj is set to the H level, n-type TFT element T5 is turned off and n-type TFT elements T7 and T8 are turned on. By the operation, a current according to data voltage Vdat is passed to n-type TFT element T6 and the gate voltage of n-type TFT element T6 for passing such a current is held at node Nb by voltage holding capacitor Cb. In such a manner, data voltage Vdat is received by the current supply circuit, the gate voltage of n-type TFT element T6 is set to the level for supplying data current Idat according to data voltage Vdat and held at node Nb.

After that, in an operation mode in which control signal Sadj is set to the L level and control signal Sscn is set to the H level, n-type TFT element T5 is turned on and n-type TFT elements T7 and T8 are turned off. By the operation, n-type TFT element T6 is electrically connected between data line DL and predetermined voltage Vss in a state where the gate voltage is held at a level for supplying data current Idat corresponding to received data voltage Vdat.

Referring again to FIG. 11, in response to activation (to the H level) of the corresponding scan line, in pixel driving circuit PDC, n-type TFT elements T1 and T4 are turned on and n-type TFT element T3 is turned off. Consequently, a current path of power source voltage Vdd, p-type TFT element T2, n-type TFT element T4, n-type TFT element T1, data line DL, n-type TFT elements T5 and T6 (FIG. 12), and predetermined voltage Vss is formed. To the current path, data current Idat corresponding to data voltage Vdat, which is according to the gate voltage of n-type TFT element T6 is passed.

At this time, in the pixel circuit, the drain and gate of p-type TFT element T2 are electrically connected to each other via n-type TFT element T4, so that the gate voltage at the time when data current Idat passes through p-type TFT element T2 is held at node Na by voltage holding capacitor Ca. As described above, in the activation period of scan line SL, data current Idat according to display luminance is programmed by pixel driving circuit PDC.

After that, when an object to be scanned is changed and scan line SL is inactivated to the L level, n-type TFT elements T1 and T4 are turned off and p-type TFT element T3 is turned on. Consequently, a current path of power source voltage Vdd, p-type TFT element T2, p-type TFT element T3, organic light emitting diode OLED, and common electrode (predetermined voltage Vss) is formed, and data current Idat programmed in the activation period of scan line SL can be continuously supplied to organic light emitting diode OLED also in the inactive period of scan line SL.

As described above, in the current-programmed pixel circuit, current supplied to the current-driven light emitting device (that is, OLED) is set on the basis of not a program of data voltage Vdat indicative of display luminance but a program of data current Idat obtained by converting data voltage Vdat. Therefore, even if a difference occurs in transistor characteristics of TFT elements of pixel circuits, non-uniformity of display luminance characteristic between pixels can be suppressed. In other words, at least between pixels sharing the current supply circuit shown in FIG. 12, uniformity of display luminance characteristic between the pixels can be expected.

However, the current supply circuit shown in FIG. 12 corresponding to the current-programmed pixel circuit has to be provided for each data line DL. Consequently, whether display luminance characteristics of pixels become uniform or not depend on whether the conversion characteristic from data voltage Vdat to data current Idat is uniform among a plurality of current supply circuits provided in a whole organic EL display.

Concretely, in the current supply circuit shown in FIG. 12, when the transistor characteristics (particularly, threshold voltage or mobility) of n-type TFT element T6 for driving data current Idat vary and uniform data current Idat cannot be generated by the current supply circuits in correspondence with data voltage Vdat at the same level, uniformity of the display luminance characteristics among pixels cannot be maintained.

In the current supply circuit according to the conventional technique shown in FIG. 12, at a timing when data line DL and the current supply circuit are connected to each other in response to activation (to the H level) of control signal Sscn, the drain voltage of n-type TFT element T6 changes discontinuously. One of problems is that data current Idat fluctuates transiently.

SUMMARY OF THE INVENTION

An object of the present invention is to provide a current supply circuit having an uniform voltage-current conversion characteristic, and an EL display apparatus using the same and having a uniform display luminance characteristic among pixels.

According to the present invention, a current supply circuit for supplying an output current according to an input voltage to a signal line, includes: a current driving portion, provided to supply the output current to the signal line, in which: a passing current changes according to a voltage of a control node; a voltage holding portion for holding the voltage of the control node; a current compensating portion for setting the control node to a voltage corresponding to a reference current by passing the reference current to the current driving portion in a first operation mode in which an input node is set to a predetermined initial voltage; and an input transmitting portion, in a second operation mode which is executed after the first mode and in which the input node receives transmission of the input voltage, for changing the voltage of the control node in accordance with a change in the voltage of the input node between the first and second operation modes.

A main advantage of the present invention is therefore that by supplying an output current after compensating the characteristics of the current driving portion on the basis of the reference current, even when element characteristics vary at the time of manufacture, the voltage-current conversion characteristic can be maintained uniform.

A display apparatus according to the present invention includes: a plurality of pixels, arranged in a matrix, each having a current-driven light emitting element; a plurality of scan lines arranged in correspondence with rows of the plurality of pixels and selected sequentially in predetermined cycles; a plurality of data lines arranged in correspondence with columns of the plurality of pixels; and first and second current supply circuits, arranged in correspondence with each of the data lines, for executing first and second operation modes complementarily to each other to supply a data current according to a data voltage which is set in correspondence with display luminance in a pixel to be scanned in the plurality of pixels to the corresponding data line. Each of the first and second current supply circuits includes: a current driving portion, provided to supply the data current to the corresponding data line, in which a passing current changes according to a voltage of a control node; a first voltage holding portion for holding the voltage of the control node; an input node, set to a predetermined initial voltage in the first operation mode, to which the data voltage is transmitted in the second operation mode; a current compensating portion for setting the control node to a voltage corresponding to a reference current by passing the reference current to the current driving portion in the first operation mode; and an input transmitting portion, in the second operation mode, for changing the voltage of the control node in accordance with a change in the voltage of the input node between the first and second operation modes. Each of the pixels includes a drive circuit for supplying a current according to the data current transmitted via the corresponding data line in an active period of the corresponding scan line to the current-driven light emitting element and continuously supplying a current corresponding to the data current to the current-driven light emitting element also in an inactive period of the corresponding scan line.

In the display apparatus, in the first and second current supply circuits for supplying a data current according to a data voltage indicative of display luminance in a pixel to be scanned, the characteristics of the current driving portion are compensated on the basis of the reference current and, after that, an output current is supplied. Consequently, even when variations occur in the element characteristics at the time of manufacture, the voltage-current conversion characteristics in current supply circuits can be maintained uniform. Therefore, uniform display characteristics among pixels are achieved and the display quality can be improved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
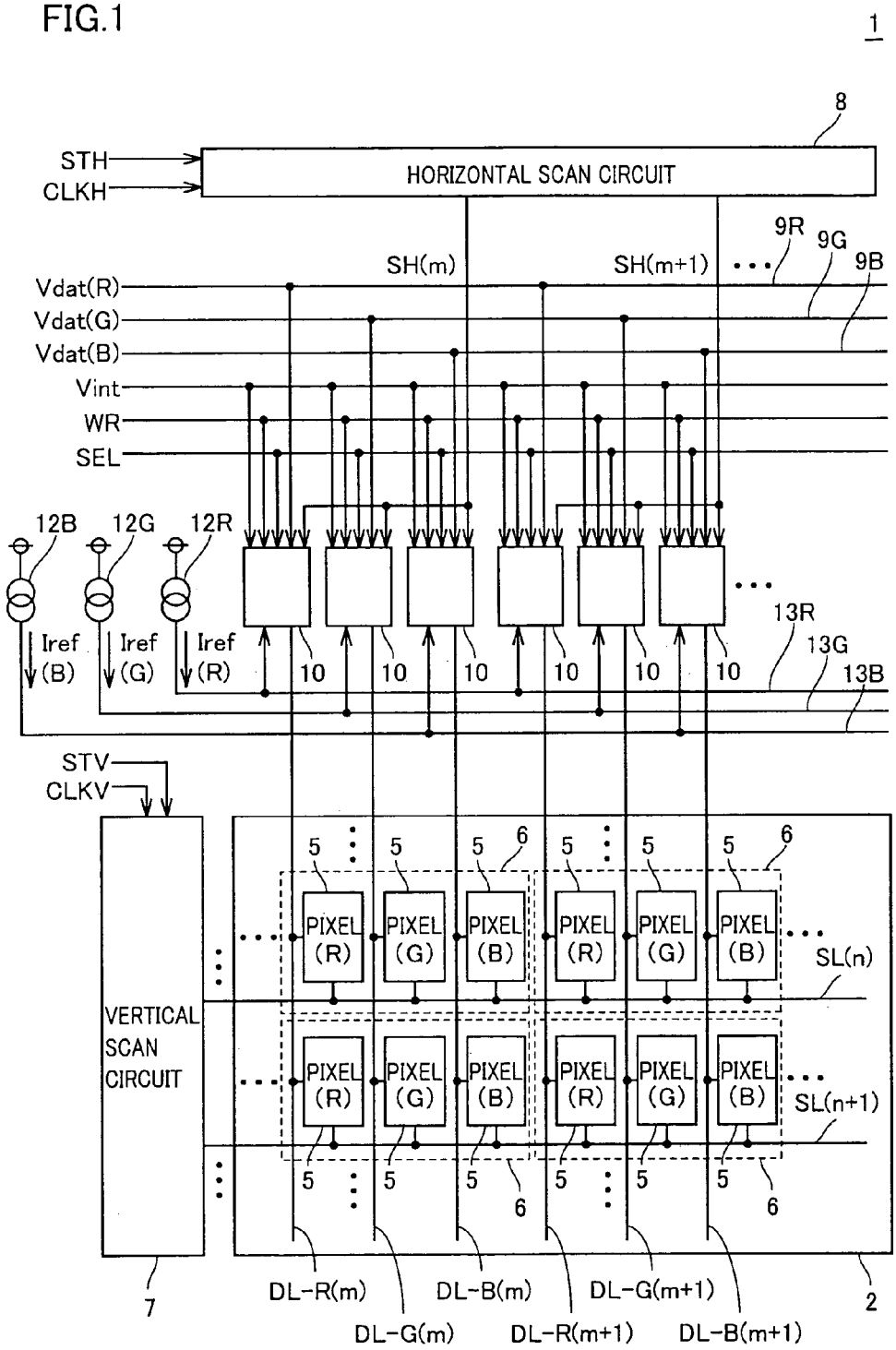
FIG. 1 is a block diagram showing a general configuration of an EL display apparatus having, as a data current supply circuit, a current supply circuit according to a first embodiment of the present invention.

Embodiments of the present invention will be described in detail hereinafter with reference to the drawings. The same reference numerals in the following indicate the same or corresponding parts.

First Embodiment

Referring to FIG. 1, an EL display apparatus 1 according to the present invention has an EL display unit 2. In EL display unit 2, a plurality of pixels 5 are arranged in a matrix. In EL display unit 2 for color display, one display unit 6 is constructed by three neighboring pixels 5. Specifically, each display unit 6 includes three pixels 5 for displaying red (R), green (G), and blue (B).

In correspondence with each row of pixels (hereinafter, also referred to as "line"), scan line SL is arranged. In correspondence with each column of pixels (hereinafter, also referred to as "pixel column"), a data line is arranged. In FIG. 1, display units of the m-th column and the (m+1)th column in the n-th line (n: natural number) and the (n+1)th line, and scan lines SL(n) and SL(n+1), data lines DL-R(m) and DL-R(m+1) corresponding to red (R) display pixels, data lines DL-G(m) and DL-G(m+1) corresponding to green (G) display pixels, and data lines DL-R(m) and DL-R(m+1) corresponding to blue (B) display pixels which correspond to the display units are representatively shown. In the following, the data lines will be also generically referred to as data lines DL.

Figure 11:
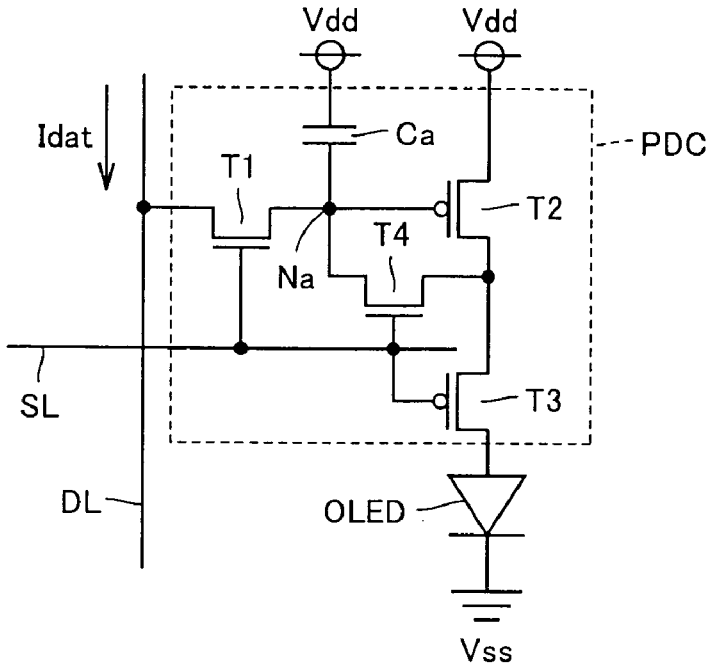
FIG.11 PRIOR ART
FIG. 11 is a circuit diagram for describing the configuration of a current-programmed pixel circuit according to a conventional technique.
Figure 12:
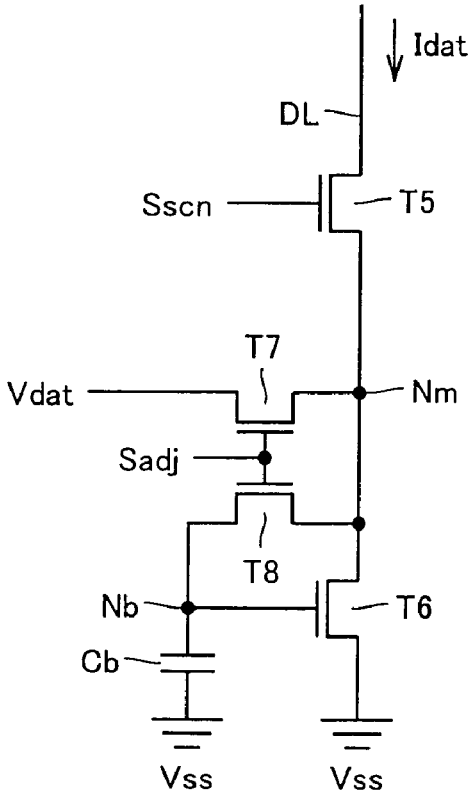
FIG.12 PRIOR ART
FIG. 12 is a circuit diagram showing the configuration of a current supply circuit according to the conventional technique for supplying a data current according to display luminance to the current-programmed pixel circuit.

The configuration of each pixel 5 is similar to, for example, that of the pixel circuit according to the conventional technique shown in FIG. 11. Specifically, in an EL display apparatus to which the present invention is applied, each pixel 5 has a current-driven light emitting device (for example, organic light emitting diode) and supply of current to the current-driven light emitting device is set on the basis of a current-programmed type configuration.

EL display apparatus 1 further includes a vertical scan circuit 7, a horizontal scan circuit 8, data voltage lines 9R, 9G, and 9B, data current supply units 10 provided in correspondence with data lines DL, reference current supply circuits 12R, 12G, and 12B, and reference current lines 13R, 13G, and 13B.

Vertical scan circuit 7 sequentially selects a plurality of lines in predetermined cycles in response to a start pulse STV and a shift clock CLKV. Specifically, a plurality of scan lines SL provided in correspondence with the lines are activated to the H level in order in predetermined cycles. In the following, a line of which corresponding scan line is activated will be also referred to as a "line to be scanned".

Horizontal scan circuit 8 generates a scan signal SH for sequentially selecting a plurality of pixel columns one by one in response to a start pulse STH and a shift clock CLKH. In FIG. 1, scan signals SH(m) and SH(m+1) corresponding to the m-th column and the (m+1)th column are representatively shown. Data voltage lines 9R, 9G, and 9B transmit data voltages Vdat(R), Vdat(G), and Vdat(B) for achieving display luminance of R, G, and B in display unit 6, respectively. Each of data voltages Vdat(R), Vdat(G), and Vdat(B) has a voltage level corresponding to display luminance. In the following, data voltages Vdat(R), Vdat(G), and Vdat(B) will be also generically referred to as data voltage Vdat and data voltage lines 9R, 9G, and 9B will be also generically referred to as data voltage line 9.

Data current supply unit 10 arranged in correspondence with each data line DL supplies a data current Idat according to data voltage Vdat to each of pixels 5 in a line to be scanned. As will be clarified in the following description, each data current supply unit 10 executes a device characteristic compensating operation for uniforming a conversion characteristic from data voltage Vdat to data current Idat. The circuit configuration and operation of data current supply unit 10 will be described in detail later.

Reference current supply circuits 12R, 12G, and 12B generate reference currents Iref(R), Iref(G), and Iref(B), respectively, used for the device characteristic compensating operation. Reference currents Iref(R), Iref(G), and Iref(B) are transmitted to data current supply units, 10 via reference current lines 13R, 13G, and 13B, respectively. In the following, reference currents Iref(R), Iref(G), and Iref(B) will be also generically referred to as reference current Iref, and reference current lines 13R, 13G, and 13B will be also generically referred to as reference current line 13.

In each scan period, data voltage Vdat corresponding to pixel 5 belonging to the line next to the line to be scanned is sequentially transmitted by data voltage line 9 in a time sharing manner. For example, in the scan period of the n-th line, to data voltage lines 9R, 9G, and 9B, data voltages Vdat(R), Vdat(G), and Vdat(B) corresponding to a display image in the (n+1)th line are transmitted. In the scan period, data current supply units 10 in pixel columns are sequentially selected on the display unit basis in response to scan signal SH from horizontal scan circuit 8, sequentially receive data voltage Vdat corresponding to the (n+1)th line from data voltage line 9, and supply data current Idat according to data voltage Vdat corresponding to the n-th line received in the scan period of the (n−1)th line to corresponding data line DL.

The configuration of the current supply circuit according to the first embodiment will now be described in detail by using data current supply unit 10 shown in FIG. 1.

Figure 2:
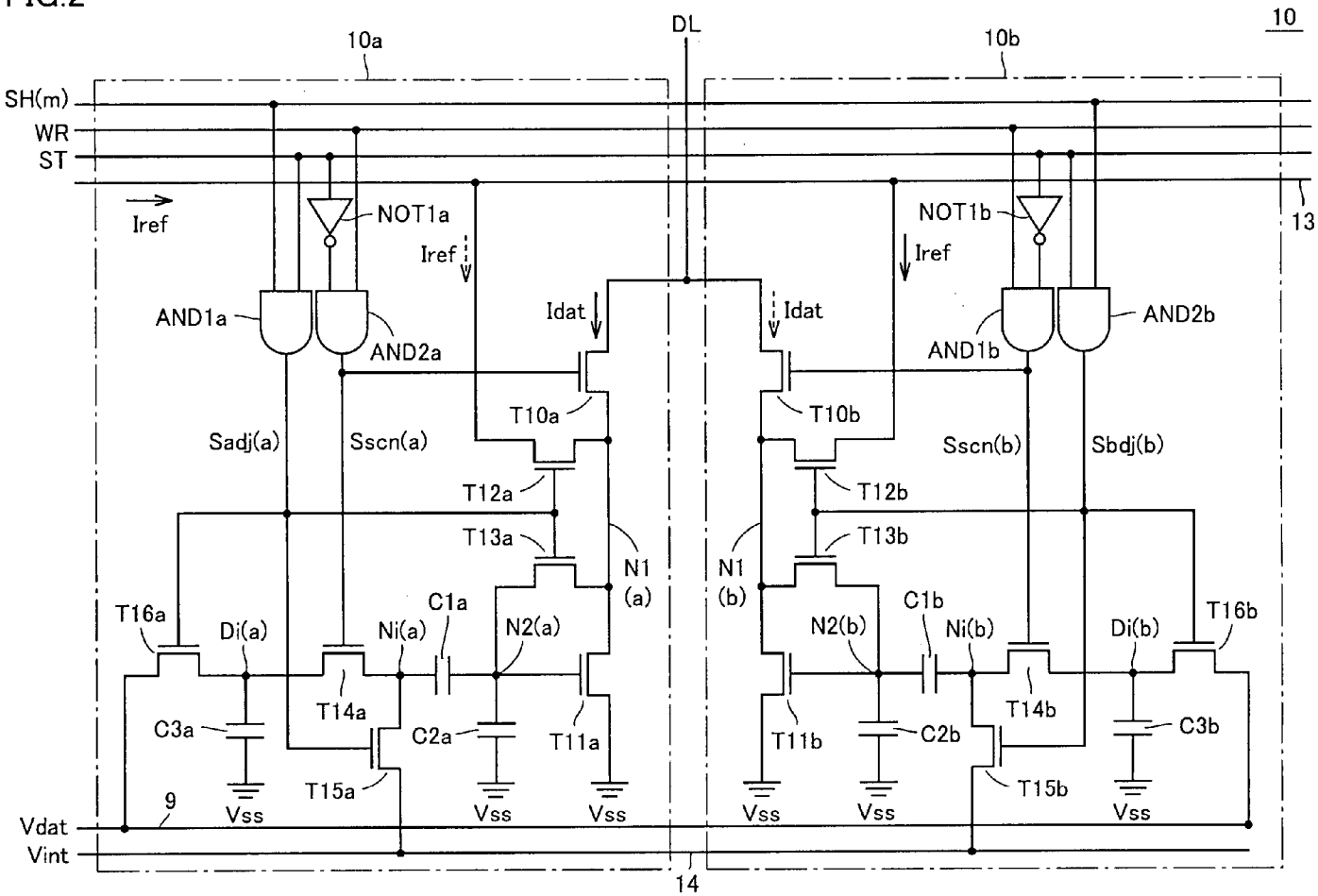
FIG. 2 is a circuit diagram showing the configuration of the current supply circuit according to the first embodiment.

FIG. 2 is a circuit diagram showing the configuration of the current supply circuit (data current supply unit 10) according to the first embodiment. In FIG. 2, data current supply unit 10 corresponding to the m-th column is representatively shown.

Referring to FIG. 2, data current supply unit 10 according to the first embodiment includes current supply circuits 10*a* and 10*b* which are set in different operation modes complementary to each other. Current supply circuit 10*a* has n-type TFT elements T10*a* to T15*a*, a transmission capacitor C1*a*, voltage holding capacitors C2*a* and C3*a*, and logic gates NOT1*a*, AND1*a*, and AND2*a*. Current supply circuit 10*b* has a configuration similar to that of current supply circuit 10*a* and includes n-type TFT elements T10*b* to T15*b*, a transmission capacitor C1*b*, voltage holding capacitors C2*b* and C3*b*, and logic gates NOT1*b*, AND 1*b*, and AND2*b*.

In the embodiment, each TFT element is formed by using, preferably, low-temperature polysilicon. N-type TFT elements T11*a* and T11*b* operate as current driving units for supplying pass currents according to voltages of nodes N2(*a*) and N2(*b*), respectively, to data line DL. In the following, therefore, n-type TFT elements T11*a* and T11*b* will be also referred to as "drive transistors".

The operation modes of current supply circuits 10*a* and 10*b* are set to a "compensation mode" and a "supply mode" complementarily to each other in accordance with selection signal ST. In the compensation mode, each current supply circuit receives data voltage Vdat of the next line to be scanned from data voltage line 9 and executes a device characteristic compensating operation on the basis of reference current Iref. In the supply mode, each current supply circuit supplies data current Idat in accordance with data voltage Vdat received in the compensation mode of last time and the compensated conversion characteristic.

In the H level period of selection signal ST, in each data current supply unit 10, current supply circuit 10*a* is set in the compensation mode and current supply circuit 10*b* is set in the supply mode. On the other hand, in the L level period of selection signal ST, in each data current supply unit 10, current supply circuit 10*a* is set in the supply mode, and current supply circuit 10*b* is set in the compensation mode. The setting of the level of selection signal ST is switched alternately each time the line to be scanned is switched, that is, every scan period.

The configuration and operation of each current supply circuit will now be described. As already described above, the configurations of current supply circuits 10*a* and 10*b* are similar to each other. In the following, therefore, current supply circuit 10*a* will be described representatively.

N-type TFT elements T10*a* and T11*a* are connected in series between data line DL and predetermined voltage Vss. As already described above, a ground voltage or a negative voltage is used as predetermined voltage Vss. N-type TFT element T12*a* is electrically coupled between reference current line 13 and node N1(*a*). N-type TFT element T13*a* is electrically coupled between nodes N1(*a*) and N2(*a*). N-type TFT element T14*a* is electrically coupled between input node Ni(a) and data node Di(a). N-type TFT element T15*a* is electrically coupled between input node Ni(a) and voltage supply line 14. Voltage supply line 14 supplies a predetermined initial voltage Vint. N-type TFT element T16*a* is electrically coupled between data node Di(a) and data voltage line 9.

Transmission capacitor C1*a* is connected between input node Ni(a) and node N2(*a*), and voltage holding capacitor C2*a* is connected between node N2(*a*) and predetermined voltage Vss. Voltage holding capacitor C3*a* is connected between data node Di(a) and predetermined voltage Vss.

Logic gate AND1*a* outputs a result of AND operation between scan signal SH(m) and selection signal ST as a control signal Sadj(a). Logic gate AND2*a* outputs a result of AND operation between selection signal ST inverted by logic gate NOT1*a* and a control signal WR as a control signal Sscn(a). Control signal WR specifies the period of supplying data current Idat in each scan period.

Therefore, in the compensation mode, in the scan period, control signal Sadj(a) is activated to the H level in accordance with an active period of scan signal SH(m). In the active period of scan signal SH(m), data voltage Vdat corresponding to the m-th column is transmitted onto data voltage line 9. On the other hand, in the supply mode, in the scan period, control signal Sscn(a) is activated to the H level in accordance with the active period of control signal WR.

Control signal Sscn(a) is inputted to the gates of n-type TFT elements T10*a* and T14*a* and control signal Sadj(a) is inputted to the gates of n-type TFT elements T12*a*, T13*a*, T15*a*, and T16*a*.

Figure 3:
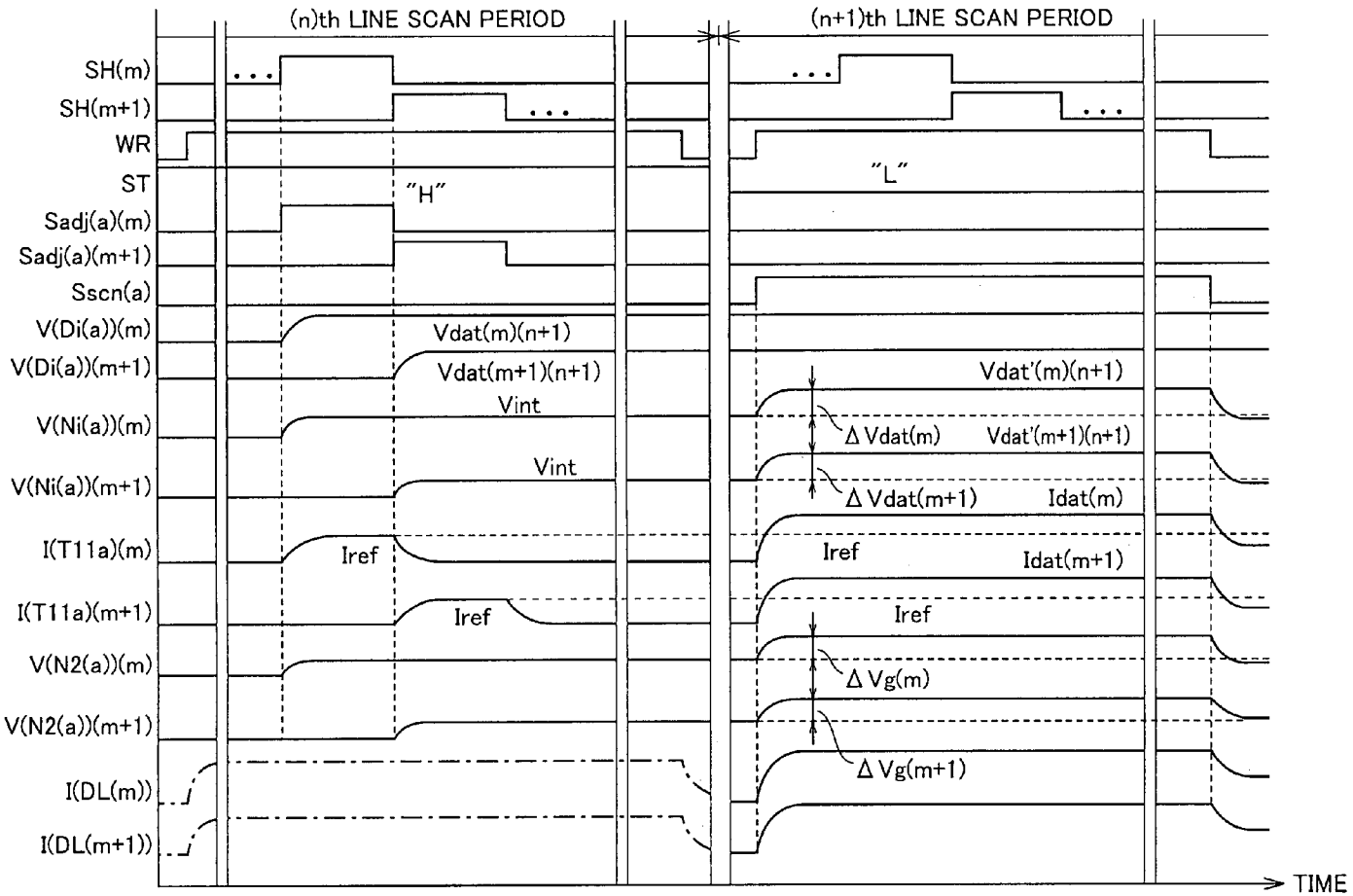
FIG. 3 is a first operation waveform chart showing operation of the current supply circuit according to the first embodiment.

The operation of current supply circuit 10*a* will now be described with reference to FIG. 3. FIG. 3 representatively shows the operation of current supply circuits 10*a* in the m-th column and the (m+1)th column.

Referring to FIG. 3, in the scan period of the n-th line, selection signal ST is set to the H level and current supply circuit 10*a* is set in the compensation mode. Therefore, in each of current supply circuits 10*a* in the m-th and (m+1)th columns, control signals Sadj(a) are sequentially activated (to the H level) in accordance with active periods of scan signals. SH(m) and SH(m+1). On the other hand, in current supply circuit 10*a* in each pixel column, control signal Sscn(a) is made inactive. Therefore, in the scan period of the n-th line, in each data current supply unit 10, supply of data current Idat is executed by current supply circuit 10*b*, not current supply circuit 10*a*.

Referring again to FIG. 2, in the compensation mode, in response to activation of control signal Sadj(a), n-type TFT elements T12*a*, T13*a*, T15*a*, and T16*a* are turned on whereas n-type TFT elements T10*a* and T14*a* are turned off. In response to turn-on of n-type TFT element T16*a*, data voltage Vdat transmitted on data voltage line 9 is received by data node Di(a) and latched by voltage holding capacitor C3*a*.

In the compensation mode, n-type TFT elements T12*a* and T13*a* operate as current compensation portion for making reference current Iref pass through n-type TFT element T11*a* as a drive transistor to set the voltage of node N2(*a*) to the level corresponding to reference current Iref. Since the drain and gate of drive transistor T11*a* are connected to each other by n-type TFT element T13*a* which is turned on, in the compensation mode, reference current Iref is passed to the path of reference current line 13, n-type TFT element T10*a*, drive transistor T11*a*, and predetermined voltage Vss, and the gate voltage when the current (source-drain current) passing through drive transistor T11*a* is reference current Iref is held at node N2(*a*). As described above, voltage holding capacitor C2*a* operates as a voltage holding portion for holding the voltage of node N2. Further, in the compensation mode, the voltage at input node Ni(a) is set to initial voltage Vint by n-type TFT element T15*a* which is turned on.

Referring again to FIG. 3, in the compensation mode, data voltage Vdat corresponding to a display image in the (n+1)th line transmitted to data voltage line 9 is sequentially received by each current supply circuit 10*a* in each pixel column. For example, voltage V (Di(a)) of data node Di(a) in current supply circuit 10*a* in the m-th column is set to the level according to a data voltage Vdat(m) (n+1) corresponding to the m-th column in the (n+1)th line and is maintained at the level. Similarly, voltage V (Di(a)) of data node Di(a) in current supply circuit 10*a* in the (m+1)th column is set to the level according to a data voltage Vdat(m+1)(n+1) corresponding to the (n+1)th line in the (m+1)th column and is maintained at the level.

In each of current supply circuits 10*a* in the m-th and (m+1)th columns, input node Ni(a) is set to initial voltage Vint. That is, in the compensation mode period, V(Ni(a)) is set to Vint.

Further, in each of current supply circuits 10*a* of the m-th and (m+1)th columns, in response to activation of corresponding control signal Sadj(a), I(T11*b*) as the current (source-drain current) passing through drive transistor T11*a* becomes reference current Iref in the active period of corresponding control signal Sadj(a), and the gate voltage of drive transistor T11*a* in this period is held at node N2(*a*).

That is, in the compensation mode, voltage V(N2(*a*))(*m*) and voltage V(N2(*a*))(m+1) at node N2(*a*) are set to the gate voltage which is set when reference current Iref passes through drive transistor T11*a*. Also after inactivation of corresponding control signal Sadj(a), the voltage is held by voltage holding capacitor C2*a*.

On the other hand, as shown in FIG. 2, n-type TFT element T10*a* operating as a switch provided between data line DL and drive transistor T11*a* is turned off, so that supply of current to data line DL by current supply circuit 10*a* which is set in the compensation mode is not executed.

In the following scan period, that is, in the scan period of the (n+1)th line, selection signal ST is set to the L level and current supply circuit 10*a* is set in the supply mode. Therefore, in the active period of control signal WR, control signal Sscn(a) is activated (to the H level) in each of current supply circuits 10*a* of the m-th and (m+1)th columns. On the other hand, in current supply circuit 10*a* of each pixel column, control signal Sadj(a) is made inactive. Therefore, in the scan period of the (n+1)th line, in each data current supply unit 10, supply of data current Idat is executed by current supply circuit 10*a*.

Referring again to FIG. 2, in the supply mode, in response to activation of control signal Sscn(a), n-type TFT elements T10*a* and T14*a* are turned on. On the other hand, n-type TFT elements T12*a*, T13*a*, T15*a*, and T16*a* are turned off. By turn-on of n-type TFT element T10*a*, drive transistor T11*a* and data line DL are electrically connected to each other.

In response to turn-on of n-type TFT element T14*a*, input nodes Ni(a) and Di(a) are connected to each other. Specifically, n-type TFT element T14*a* operates as a switch for disconnecting input nodes Ni(a) and Di(a) in the compensation mode and connecting input nodes Ni(a) and Di(a) in the supply mode. As a result, input node Ni(a) changes from initial voltage Vint to a voltage level Vdat' according to data voltage Vdat received in the preceding compensation mode.

A voltage change ΔVdat of input node Ni(a) between the compensation mode and the supply mode is expressed as ΔVdat=Vdat'−Vint. Transmission capacitor C1*a* operates as an input transmitting portion for changing the voltage at node N2(*a*) in accordance with a voltage change in input node Ni(a) by capacitive coupling.

Accordingly, as shown in FIG. 3, the voltage at node N2(*a*) changes by ΔVg in accordance with ΔVdat. For example, voltage V(N2(*a*)) at node N2(*a*) changes by ΔVg (m) in accordance with a voltage difference ΔVdat(m) between voltage Vdat'(m)(n+1) according to data voltage Vdat(m)(n+1) and initial voltage Vint. In current supply circuit 10*a* in the (m+1)th column, voltage V(N2(*a*)) at node N2(*a*) changes by ΔVg(m+1) in accordance with a voltage difference ΔVdat(m+1) between a voltage Vdat'(m+1)(n+1) according to data voltage Vdat(m+1)(n+1) and initial voltage Vint.

Further, a current according to the voltage at node N2(*a*) is supplied to corresponding data line DL by drive transistor T11*a*. To be specific, currents I(DL(m)) and I(DL(m+1)) supplied to data line DL in the (n+1)th line scan period become at the levels Idat(m) and Idat(m+1) corresponding to data voltages Vdat(m)(n+1) and Vdat(m+1)(n+1), respectively.

As a result, data current Idat according to data voltage Vdat can be supplied from current supply circuit 10*a* to data line DL. Therefore, display luminance of a pixel to which data current Idat is supplied can be controlled by data voltage Vdat. That is, with respect to data voltage Vdat, the above-described voltage difference ΔVdat is set in accordance with the difference between the set value (target value) of the data current corresponding to display luminance and reference current Iref.

In FIG. 2, a configuration of arranging delay circuits for delaying transmission of control signals Sscn(a) and Sscn(b) between logic gates AND2*a* and AND2*b* and n-type TFT elements T14*a* and T14*b*, respectively, can be also employed. With such a configuration, in the beginning of the supply mode, the voltages at input nodes Ni(a) and Ni(b) are maintained at initial voltage Vint for a predetermined period corresponding to delay time of the delay circuits and, after that, data voltage Vdat can be received. It can prevent fluctuation of the drain voltage of drive transistor T11*a* from becoming excessive at start of supply of data current Idat, so that transient fluctuation in data current Idat can be suppressed.

Figure 4:
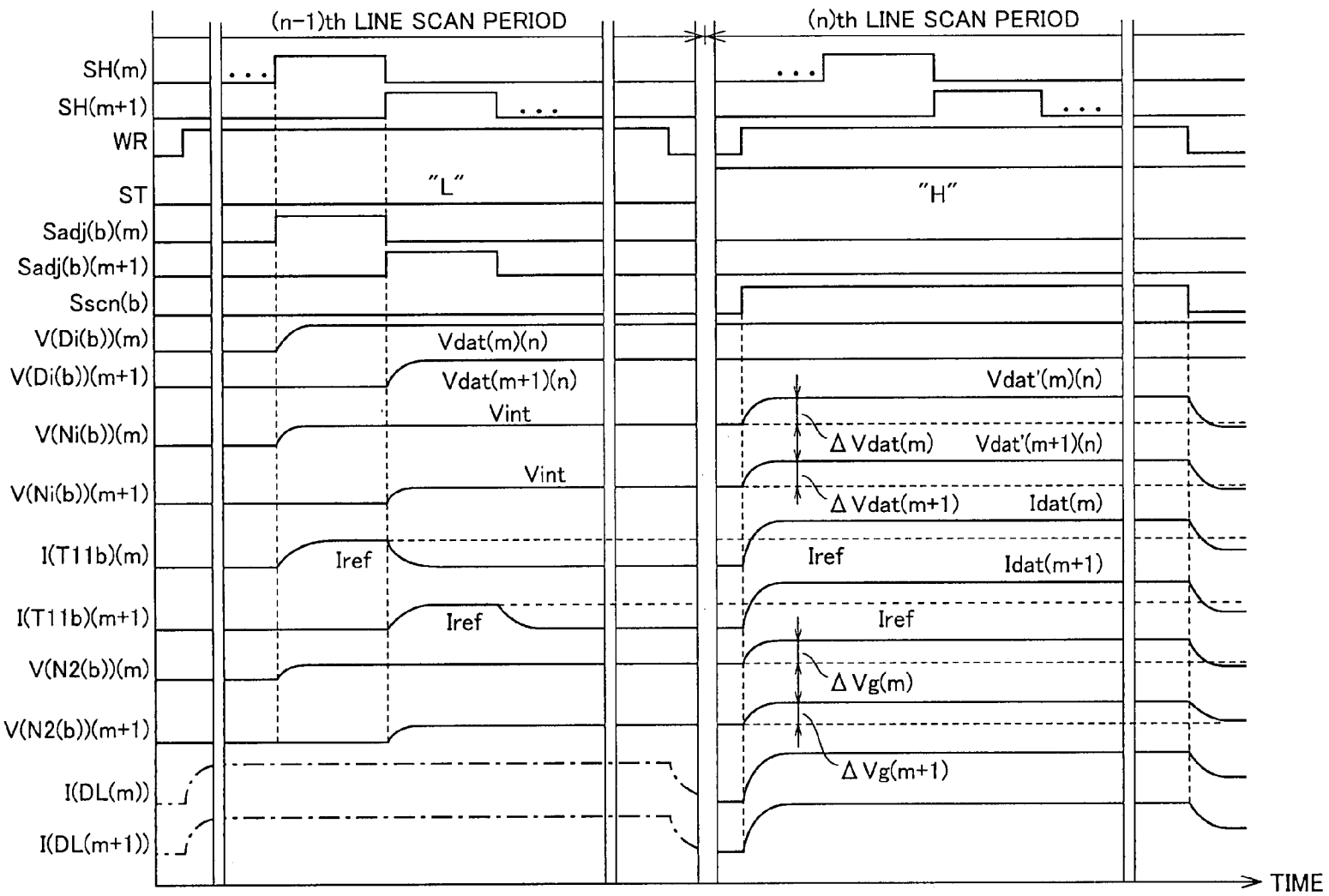
FIG. 4 is a second operation waveform chart showing operation of the current supply circuit according to the first embodiment.

With reference to FIG. 4, the operation of current supply circuit 10*b* which is set in the operation mode complementarily to the operation mode of current supply circuit 10*a* will now be described. FIG. 4 representatively shows operation of current supply circuits 10*b* in the m-th and (m+1)th columns.

Referring to FIG. 4, in the scan period of the (n−1)th line, selection signal ST is set to the L level and current supply circuit 10*b* is set in the compensation mode. Therefore, in accordance with the active periods of scan signals SH(m) and SH(m+1), control signal Sadj(b) is sequentially activated (to the H level) in each of current supply circuits 10*b* in the m-th and (m+1)th columns. On the other hand, in current supply circuit 10*b* of each pixel column, control signal Sscn(b) is made inactive.

The operation of current supply circuit 10*b* in the compensation mode is similar to that in the n-th line scan period of current supply circuit 10*a* described above with reference to FIG. 3, so that the detailed description will not be repeated. In the scan period, data voltage Vdat corresponding to a display image of the next line to be scanned (the n-th line), which is transmitted to data voltage line 9 is sequentially received by current supply circuits 10*b* in pixel columns. Further, in each of current supply circuits 10*b*, input node Ni(b) is set to initial voltage Vint, device characteristic compensating operation is executed, and the gate voltage at the time when current passing through drive transistor T11*b* is reference current Iref is held at node N2(*b*).

In the n-th line scan period as the next scan period, selection signal ST is set to the H level, and current supply circuit 10*b* is set in the supply mode complementarily to the mode of current supply circuit 10*a*. Therefore, in the active period of control signal WR, control signal Sscn(b) is activated (to the H level) in each of current supply circuits 10*a* in the m-th and (m+1)th columns. On the other hand, in current supply circuit 10*b* in each pixel column, control signal Sadj(b) is made inactive.

Since the operation of current supply circuit 10*b* in the supply mode is similar to that in the (n+1)th line scan period of current supply circuit 10*a* described above with reference to FIG. 3, the detailed description will not be repeated. In short, data current Idat according to data voltage Vdat received in the (n−1)th line scan period is supplied from current supply circuit 10*b* to data line DL.

Particularly, the operation in each of scan periods of two current supply circuits 10*a* and 10*b* which are complementarily set in the compensation mode and the supply mode will be understood from the operation waveforms in the n-the line scan period in FIGS. 3 and 4.

As described above, in each data current supply unit 10, each of current supply circuits 10*a* and 10*b* executes device characteristic compensation using common reference current Iref in the compensation mode, after that, is set in the supply mode, and starts supplying data current Idat. As a result, transistor characteristic variations in drive transistors T11*a* and T11*b* between data current supply units 10 are compensated.

Figure 5:
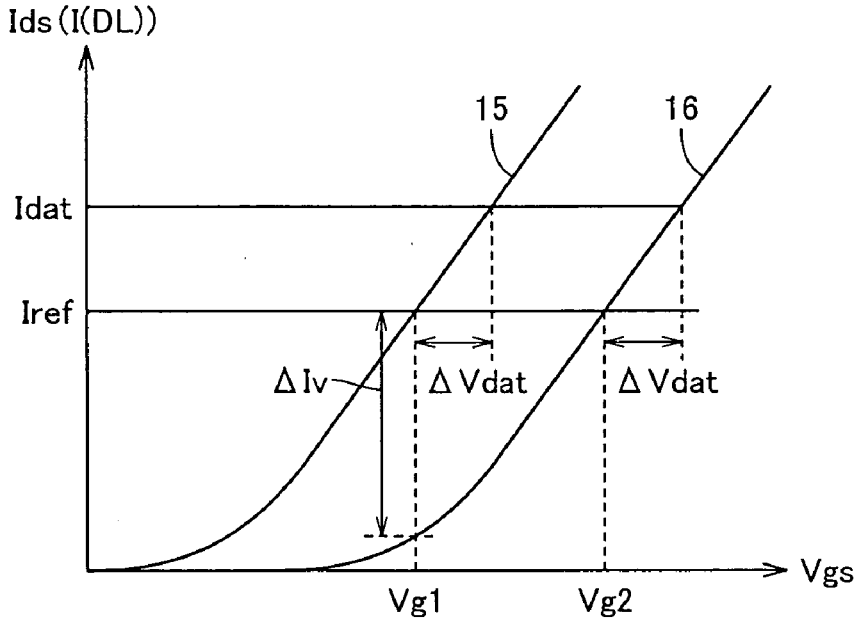
FIG. 5 is a conceptual diagram illustrating device characteristic compensating operation in a compensation mode in the current supply circuit according to the first embodiment.

FIG. 5 is a conceptual diagram for describing device characteristic compensating operation in the compensation mode in the current supply circuit according to the first embodiment.

Referring to FIG. 5, as characteristics of drive transistors T11*a* and T11*b* in current supply circuits 10*a* and 10*b*, device characteristic lines each indicative of the relation between a gate-source voltage Vgs and a source-drain current Ids are shown. Gate-source voltage Vgs corresponds to voltages at nodes N2(*a*) and N2(*b*) in current supply circuits 10*a* and 10*b*. Source-drain current Ids corresponds to current I(DL) supplied to data line DL.

Device characteristic lines 15 and 16 correspond to drive transistors included in different current supply circuits. At a design stage, it is considered so that transistor characteristics of drive transistors in the different current supply circuits are the same. However, due to manufacture variations which occur in actual process, the device characteristic lines of the drive transistors do not always coincide with each other. Particularly, in a TFT using low-temperature polysilicon, manufacture variations tend to occur and mismatch between the device characteristic lines easily occurs.

When data current Idat is generated by using drive transistors of different characteristics, the voltage-current conversion characteristic from data voltage Vdat to data current Idat varies in the current supply circuits. That is, display luminance corresponding to data voltage Vdat at the same level varies among groups of pixels corresponding to the same current supply circuit. As a result, uniformity of the display luminance characteristic in the whole EL display apparatus deteriorates.

For example, as shown in FIG. 5, also in the case where a common data voltage is received and the gate voltage is set to Vg1, between drive transistors corresponding to device characteristic lines 15 and 16, the difference of ΔIv occurs in source-drain currents Ids, that is, data currents Idat supplied.

In contrast, in each of the current supply circuits according to the first embodiment, the compensation mode based on common reference current Iref is executed. In each data current supply unit 10, the gate voltage for supplying reference current Iref is obtained. For example, in drive transistors corresponding to device characteristic lines 15 and 16, gate voltages Vg1 and Vg2 for passing reference current Iref are obtained and held, respectively.

Further, in the supply mode, data voltage Vdat is reflected as a voltage change from the compensation mode in the gate voltage of each drive transistor. Therefore, data current Idat supplied by the drive transistors corresponding to device characteristic lines 15 and 16 according to voltage change ΔVdat which is caused by the data voltage at the same level can be set to the same level by compensating variations in the transistor characteristic.

It is desirable that reference current Iref be set within a change range of data current Idat corresponding to the display luminance range in each pixel.

As described above, in the current supply circuit according to the first embodiment, also in the case where the characteristics of drive transistors vary, the voltage-current conversion characteristic can be maintained to be uniform. Therefore, in the EL display apparatus using such a current supply circuit, the display characteristics of pixels are made uniform and display quality can be improved.

Second Embodiment

In a second embodiment, as a variation of the configuration of the first embodiment, a configuration obtained by changing the polarities of TFT elements will be described.

Figure 6:
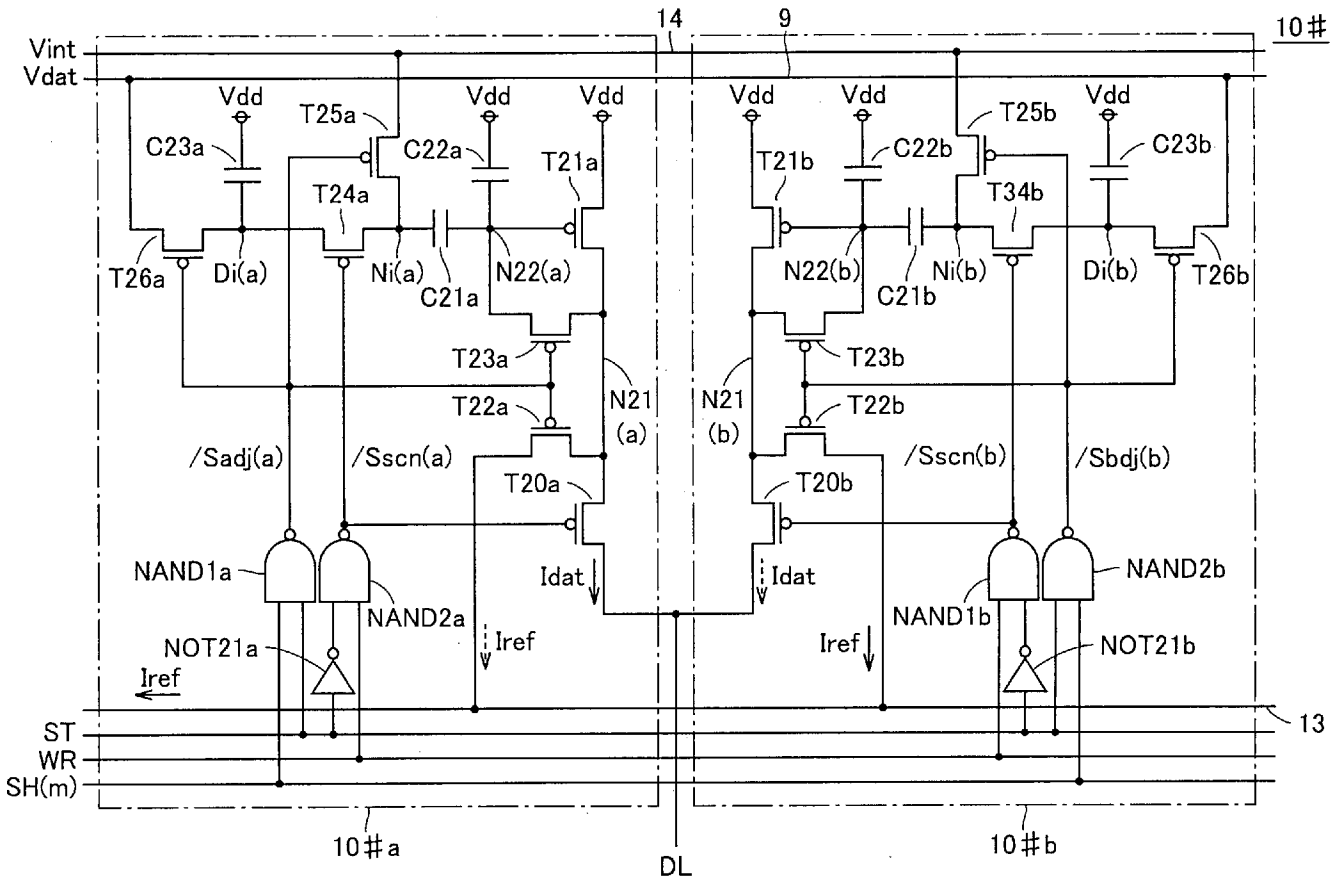
FIG. 6 is a circuit diagram showing the configuration of a data current supply circuit according to a second embodiment.

FIG. 6 is a circuit diagram showing the configuration of a current supply circuit according to the second embodiment. In FIG. 6, a data current supply unit 10# corresponding to the m-th column is representatively shown.

Referring to FIG. 6, data current supply unit 10# according to the second embodiment includes current supply circuits 10#*a* and 10#*b* set in different operation modes which are complementary to each other. Current supply circuit 10#*a* has p-type TFT elements T20*a* to T25*a*, a transmission capacitor C21*a*, voltage holding capacitors C22*a* and C23*a*, and logic gates NOT21*a*, NAND1*a*, and NAND2*a*. Current supply circuit 10#*b* has a configuration similar to that of current supply circuit 10#*a* and includes p-type TFT elements T20*b* to T25*b*, a transmission capacitor C21*b*, voltage holding capacitors C22*b* and C23*b*, and logic gates NOT21*b*, NAND1*b*, and NAND2*b*.

Each of the operation modes of current supply circuits 10#*a* and 10#*b* is set to the "compensation mode" or the "supply mode" in accordance with selection signal ST. Since the configurations of current supply circuits 10#*a* and 10#*b* are similar to each other, in the following, current supply circuit 10#*a* will be representatively described.

P-type TFT elements T20*a* and T21*a* are connected in series between data line DL and power source voltage Vdd. P-type TFT element T22*a* is electrically coupled between reference current line 13 and node N21(*a*). P-type TFT element T23*a* is electrically coupled between nodes N21(*a*) and N22(*a*). P-type TFT element T24*a* is electrically coupled between input node Ni(a) and data node Di(a). P-type TFT element T25*a* is electrically coupled between input node Ni(a) and voltage supply line 14 for supplying initial voltage Vint. P-type TFT element T26*a* is electrically coupled between data node Di(a) and data voltage line 9.

Transmission capacitor C21*a* is connected between input node Ni(a) and node N22(*a*), and voltage holding capacitor C22*a* is connected between node N22(*a*) and power source voltage Vdd. Voltage holding capacitor C23*a* is connected between data node Di(a) and power source voltage Vdd.

Logic gate NAND1*a* outputs, as a control signal /Sadj(a), a result of NAND operation between scan signal SH(m) and selection signal ST. Logic gate NAND2*a* outputs, as a control signal /Sscn(a), a result of NAND operation between selection signal ST inverted by logic gate NOT21*a* and control signal WR. That is, in current supply circuit 10#*a*, in the compensation mode, control signal /Sadj(a) is activated to the L level. In the supply mode, control signal /Sscn(a) is activated to the L level. To each of gates of p-type TFT elements T20*a* and T24*a*, control signal /Sscn(a) is inputted. To each of the gates of p-type TFT elements T22*a*, T23*a*, T25*a*, and T26*a*, control signal Sadj(a) is inputted.

As described above, in current supply circuit 10#*a* according to the second embodiment, p-type TFT elements T20*a* to T26*a* are arranged in place of n-type TFT elements T10*a* to T16*b* shown in FIG. 2. Current supply circuit 10#*a* is connected to power source voltage Vdd, not predetermined voltage Vss.

Further, data line DL is driven by power source voltage Vdd by current supply circuits 10#*a* and 10#*b*. In the configuration according to the second embodiment, therefore, the configuration of each pixel is also different from that in the first embodiment.

Figure 7:
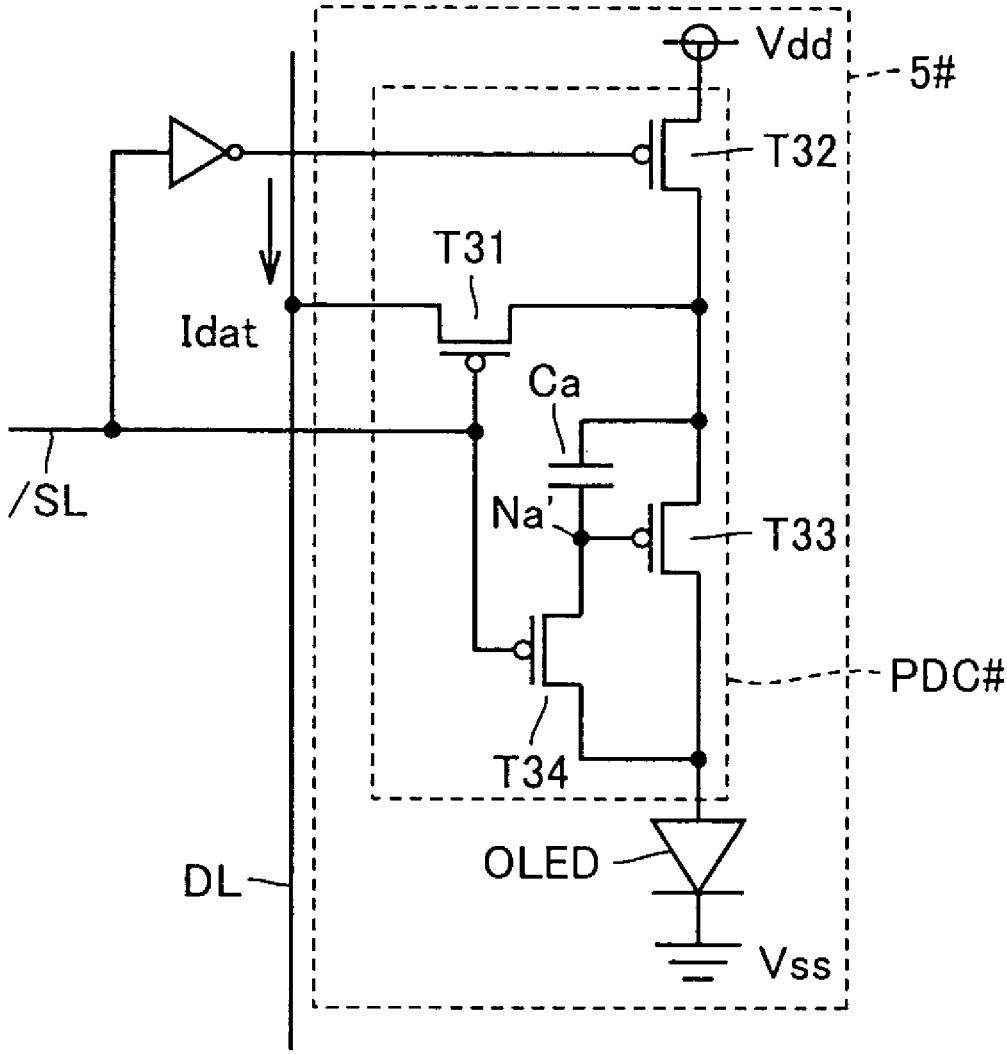
FIG. 7 is a circuit diagram illustrating the configuration of a pixel according to the second embodiment.

Referring to FIG. 7, in the configuration according to the second embodiment, a pixel 5# includes organic light emitting diode OLED and a pixel driving circuit PDC#. Pixel driving circuit PDC# has p-type TFT elements T31 to T34 and voltage holding capacitor Ca.

P-type TFT elements T32 and T33 are connected in series between power source voltage Vdd and organic light emitting diode OLED. P-type TFT element T31 is electrically coupled between corresponding data line DL and a connection node of p-type TFT elements T32 and T33, and p-type TFT element T34 is electrically coupled between a node Na' and the anode of organic light emitting diode OLED. The gates of p-type TFT elements T31 and T34 are coupled to corresponding scan line /SL. Scan line /SL is activated to the L level in a selected scan line, and is inactivated to the H level in the other lines. The gate of p-type TFT element 32 receives the inversion level of corresponding scan line /SL. The gate of p-type TFT element T33 is coupled to node Na'. Voltage holding capacitor Ca is connected between a connection node of p-type TFT elements T32 and T33 and node Na'. The voltage of node Na', that is, the gate voltage of p-type TFT element T33 is held by voltage holding capacitor Ca.

Organic light emitting diode OLED is arranged between p-type TFT element T33 and a common electrode in a manner similar to the pixel circuit of FIG. 11 of a cathode common configuration. Specifically, the cathode of organic light emitting diode OLED is connected to a common electrode to which predetermined voltage Vss is supplied.

The operation of the current supply circuit according to the second embodiment will now be described.

Referring again to FIG. 6, in current supply circuit 10#*a*, in the compensation mode, p-type TFT elements T22*a*, T23*a*, T25*a*, and T26*a* are turned on whereas p-type TFT elements T20*a* and T24*a* are turned off. Therefore, in data current supply unit 10#*a*, in association with change of the polarities of the TFT elements, the polarity of each of the gate voltage change in drive transistor T21*a* and the voltage change in input node Ni(a) is set to be opposite to the polarity of each of voltages V(Ni(a)) and V(N2(*a*)) in the operation waveform chart shown in FIG. 3. Except for the above, operation similar to that in FIG. 3 is performed and the operations of receiving data voltage Vdat and compensating the device characteristics of the drive transistors are executed. In the configuration according to the second embodiment, different from the configuration according to the first embodiment, data voltage Vdat has to be set in consideration of the point that when voltage change ΔVdat from initial voltage Vint in input node Ni(a) is negative, data current Idat becomes higher than reference current Iref.

In the supply mode, in current supply circuit 10#*a*, p-type TFT elements T22*a*, T23*a*, T25*a*, and T26*a* are turned off whereas p-type TFT elements T20*a* and T24*a* are turned on. Therefore, p-type TFT element T21*a* is electrically connected between power source voltage Vdd and data line DL in a state where the gate voltage (voltage at node N22(*a*)) is held at the level for supplying data current Idat corresponding to data voltage Vdat received in the compensation mode. The operation of current supply circuit 10#*a* in the supply mode is also similar to that of current supply circuit 10*a* in the operation waveform chart of FIG. 3 except that the polarities of a gate voltage change in drive transistor T21*a* and a voltage change of input node Ni(a) are opposite. Consequently, the detailed description will not be repeated.

Referring again to FIG. 7, in response to activation of corresponding scan line /SL (to the L level), in pixel driving circuit PDC#, p-type TFT elements T31 and T34 are turned on and n-type TFT element T32 is turned off. By the operation, a current path of power source voltage Vdd, drive transistor T21*a* (FIG. 6), data line DL, p-type TFT element T31, p-type TFT element T33, organic light emitting diode OLED, and predetermined voltage Vss is formed. To the current path, data current Idat corresponding to data voltage Vdat according to the gate voltage of drive transistor T21*a* is passed.

At this time, since the drain and gate of p-type TFT element T33 are electrically connected to each other via p-type TFT element T34, the gate voltage for passing data current Idat to p-type TFT element T33 is held at node Na' by voltage holding capacitor Ca. In such a manner, in the active period of scan line /SL, data current Idat according to display luminance is programmed by pixel driving circuit PDC#.

After that, when an object to be scanned is switched and scan line /SL is inactivated to the H level, p-type TFT elements T31 and T34 are turned off and p-type TFT element T32 is turned on. By the operation, a current path of power source voltage Vdd, p-type TFT element T32, p-type TFT element T33, organic light emitting diode OLED, and common electrode (predetermined voltage Vss) is formed. Data current Idat programmed in the active period of scan line /SL can be continuously supplied to organic light emitting diode OLED also in the inactive period of scan line SL.

The operation mode of current supply circuit 10#*b* is set complementarily to that of current supply circuit 10#*a*. The circuit operation in each operation mode is similar to that in current supply circuit 10#*a*. Also in the configuration according to the second embodiment, current supply circuits 10#*a* and 10#*b* constructing each data current supply unit are alternately set in the compensation mode and the supply mode every scan period and supply of data current to pixels in a line to be scanned is executed.

As described above, even when the polarity of a TFT element is changed from the n type to the p type in the current supply circuit and pixel driving circuit, effects similar to those of the first embodiment can be enjoyed.

Third Embodiment

In a third embodiment, the configuration of setting reference current Iref used in the compensation mode of data current supply unit 10 in finer stages and more effectively uniforming the display characteristics in pixels will be described.

Figure 8:
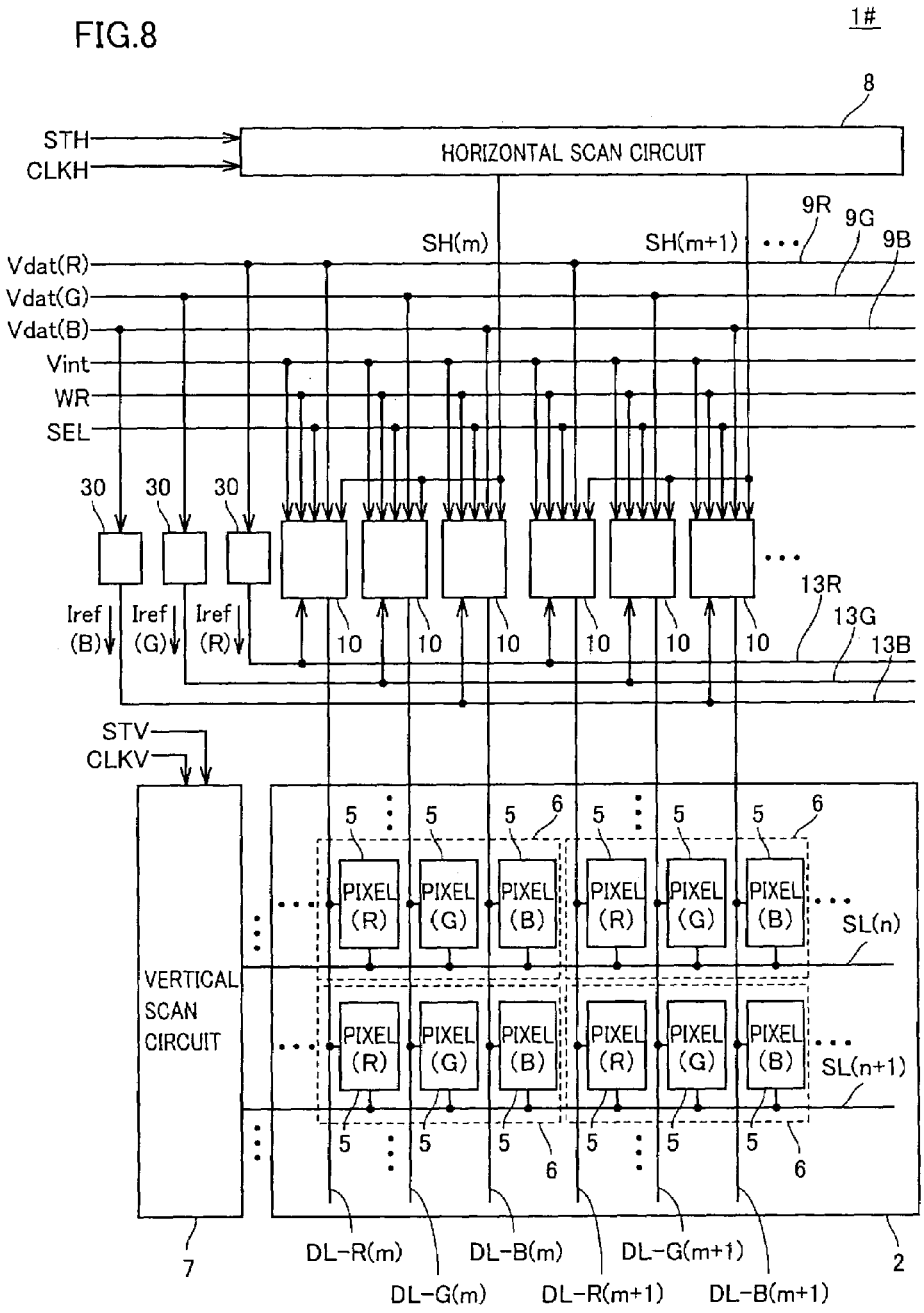
FIG. 8 is a circuit diagram for describing the configuration of an EL display apparatus according to a third embodiment.

Referring to FIG. 8, the configuration of a display apparatus 1# according to the third embodiment is different from that in the first embodiment shown in FIG. 1 with respect to that point that a reference current adjusting circuit 30 for adjusting reference current Iref in accordance with a data current set value (target value) corresponding to display luminance is provided in place of each of reference current supply circuits 12R, 12G, and 12B.

Figure 9:
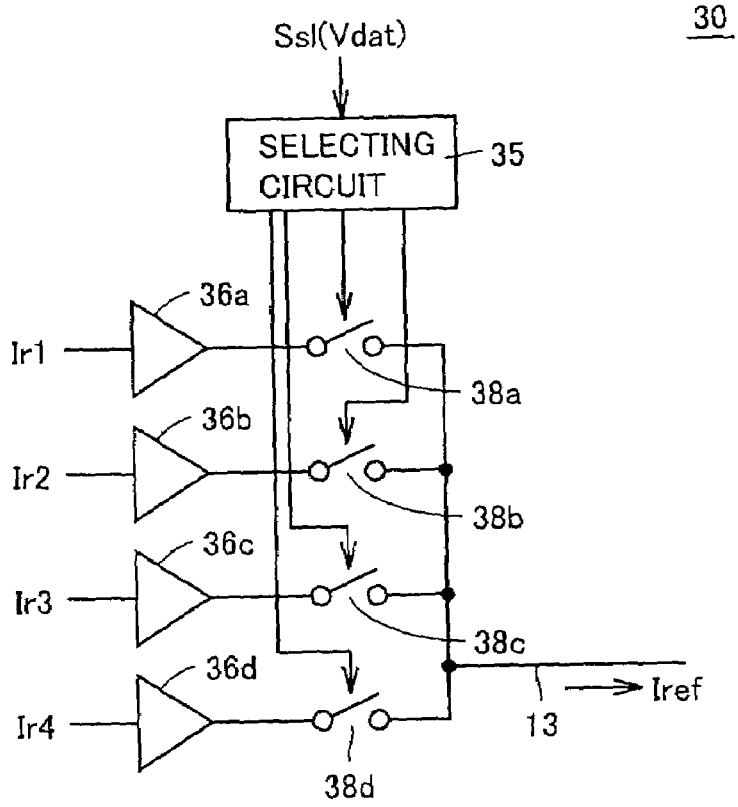
FIG. 9 is a circuit diagram for describing the configuration of a reference current adjusting circuit shown in FIG. 8.

Referring to FIG. 9, reference current adjusting circuit 30 has a selecting circuit 35 for making a selection in accordance with a data current set value, current generating circuits 36*a* to 36*d* for generating constant currents Ir1 to Ir4 of different levels, respectively, and switches 38*a* to 38*d* provided between current generating circuits 36*a* to 36*d* and reference current line 13, respectively. Selecting circuit 35 selectively turns on one of switches 38*a* to 38*d* in response to the data current set value, that is, a signal Ss1 indicative of any of zones 41 to 44 (FIG. 10) to which data current to be supplied belongs. Signal Ss1 can be generated, for example, according to data voltage Vdat.

Figure 10:
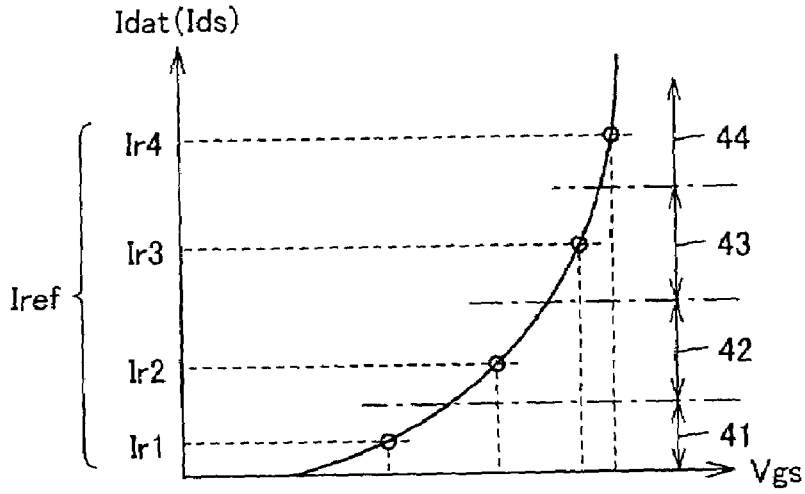
FIG. 10 is a conceptual diagram for describing operation of a selecting circuit shown in FIG. 9.

FIG. 10 is a conceptual diagram for describing the operation of selecting circuit 35.

FIG. 10 shows the relation between gate voltage (data voltage Vdat) and pass current (data current Idat) corresponding to a representative device characteristic curve (for example, design value) of a drive transistor in data current supply unit 10.

In the device characteristic curve, in the zone where the gradient of a tangent largely changes, that is, in a drive transistor, the level of data current Idat is divided into, for example, four zones 41 to 44 so as to divide the zone in which the ratio of a change in pass current (source-drain current) to a change in gate voltage largely changes. Further, constant currents Ir1 to Ir4 generated by current generating circuits 36*a* to 36*d* are determined so as to correspond to center points in zones 41 to 44, respectively.

For example, when a data current set value belongs to zone 42, it is proper to set reference current Iref to Ir2, so that switch 38*b* is selectively turned on. Data voltage Vdat is set on the basis of the gate voltage of a drive transistor when corresponding reference current Iref (Ir2) is supplied in accordance with the difference between the data current set value and corresponding reference current Iref in each of zones 41 to 44.

With such a configuration, the transistor characteristics of a drive transistor in the current supply circuit are compensated more finely in the compensation mode, thereby enabling uniformity of the voltage-current conversion characteristic to be improved. As a result, the display quality of the EL display apparatus can be further improved.

The configuration according to the third embodiment can be similarly applied to the configuration of a current supply circuit and a pixel according to the second embodiment. Since reference current Iref is unconditionally determined for operation at the post stage of data current supply unit 10, it is unnecessary to distinguish the operation at the post stage.

Although a pixel with the cathode common configuration is described in the embodiment, the present invention can be also applied to a pixel with an anode common configuration. In this case, in each pixel and each current supply circuit, the position of predetermined voltage Vss and that of power source voltage Vdd are replaced with each other and, as necessary, the polarity of a TFT element and the polarity of gate voltage are changed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A current supply circuit for supplying an output current according to an input voltage to a signal line, comprising:

a current driving portion, provided to supply said output current to said signal line, in which a passing current changes according to a voltage of a control node;

a voltage holding portion for holding the voltage of said control node;

a current compensating portion for setting said control node to a voltage corresponding to a reference current by passing said reference current to said current driving portion in a first operation mode in which an input node is set to a predetermined initial voltage; and an input transmitting portion, in a second operation mode which is executed after said first mode and in which said input node receives transmission of said input voltage, for changing the voltage of said control node held by said voltage holding portion, by a voltage according to a change in the voltage of said input node between said first and second operation modes.

2. The current supply circuit according to claim 1, wherein said output current is supplied to a current-driven light emitting element, and said input voltage is set to a level corresponding to display luminance of said current-driven light emitting element.

3. The current supply circuit according to claim 1, further comprising:

a switch portion provided between said current driving portion and said signal line and turned on in said second operation mode, wherein in an ON period of said switch portion, a voltage of said input node is maintained at said predetermined initial voltage for a predetermined period and, after that, said input voltage is transmitted to said input node.

4. A current supply circuit for supplying an output current according to an input voltage to a signal line, comprising:

a current driving portion, provided to supply said output current to said signal line, in which a passing current changes according to a voltage of a control node;

a voltage holding portion for holding the voltage of said control node;

a current compensating portion for setting said control node to a voltage corresponding to a reference current by passing said reference current to said current driving portion in a first operation mode in which an input node is set to a predetermined initial voltage; and an input transmitting portion, in a second operation mode which is executed after said first mode and in which said input node receives transmission of said input voltage, for changing the voltage of said control node in accordance with a change in the voltage of said input node between said first and second operation modes, wherein said signal line is electrically coupled to a first voltage at least in said second operation mode, said current driving portion has a first transistor, electrically coupled between a second voltage and a first node, having a gate coupled to said control node, said voltage holding portion has a first capacitive element connected between said control node and said second voltage, said current compensating portion has;

a second transistor electrically coupled between said first node and a line for supplying said reference current and turned on in said first operation mode; and a third transistor electrically coupled between said first node and said control node and turned on in said first operation mode, said input transmitting portion has a second capacitive element connected between said input node and said control node, and said current supply further comprises;

a fourth transistor electrically coupled between said first node and said signal line and turned on at least in said second operation mode.

5. The current supply circuit according to claim 4, wherein said first voltage is a positive voltage, and each of said first, second, third and fourth transistors is an n-type polysilicon thin film transistor.

6. The current supply circuit according to claim 4, wherein said first voltage is a ground voltage or a negative voltage, and each of said first, second, third and fourth transistors is a p-type polysilicon thin film transistor.

7. A display apparatus comprising:

a plurality of pixels, arranged in a matrix, each having a current-driven light emitting element;

a plurality of scan lines arranged in correspondence with rows of said plurality of pixels and selected sequentially in predetermined cycles;

a plurality of data lines arranged in correspondence with columns of said plurality of pixels; and first and second current supply circuits, arranged in correspondence with each of said data lines, for executing first and second operation modes complementarily to each other to supply a data current according to a data voltage which is set in correspondence with display luminance in a pixel to be scanned in said plurality of pixels to the corresponding data line, wherein each of said first and second current supply circuits includes:

a current driving portion, provided to supply said data current to the corresponding data line, in which a passing current changes according to a voltage of a control node;

a first voltage holding portion for holding the voltage of said control node;

an input node, set to a predetermined initial voltage in said first operation mode, to which said data voltage is transmitted in said second operation mode;

a current compensating portion for setting said control node to a voltage corresponding to a reference current by passing said reference current to said current driving portion in said first operation mode; and an input transmitting portion, in said second operation mode, for changing the voltage of said control node in accordance with a change in the voltage of said input node between said first and second operation modes, and each of said pixels includes a drive circuit for supplying a current according to said data current transmitted via the corresponding data line in an active period of the corresponding scan line to said current-driven light emitting element and continuously supplying a current corresponding to said data current to said current-driven light emitting element also in an inactive period of said corresponding scan line.

8. The display apparatus according to claim 7, wherein said data voltage is set in accordance with a difference between a set value of a data current corresponding to said display luminance and said reference current.

9. The display apparatus according to claim 7, wherein said drive circuit electrically couples the corresponding data line to a first voltage in said second operation mode, said current driving portion includes a first transistor, electrically coupled between a second voltage and a first node, having a gate coupled to said control node, said first voltage holding portion has a first capacitive element connected between said control node and said second voltage, said current compensating portion has:

a second transistor electrically coupled between said first node and a line for supplying said reference current and turned on in said first operation mode; and a third transistor electrically coupled between said first node and said control node and turned on in said first operation mode, said input transmitting portion has a second capacitive element connected between said input node and said control node, and each of said first and second current supply circuits further includes a fourth transistor electrically coupled between said first node and the corresponding data line and turned on at least in said second operation mode.

10. The display apparatus according to claim 7, wherein each of said first and second current supply circuits further includes:

a second voltage holding portion for holding said data voltage at a data node; and a switch circuit for disconnecting said data node and said input node in said first operation mode and connecting said data node and said input node in said second operation mode, and in each of said first and second current supply circuits, the data voltage corresponding to a pixel to be scanned later is transmitted to said data node in said first operation mode.

11. The display apparatus according to claim 10, wherein in said first and second current supply circuits, said first and second operation modes are switched in correspondence with a switch of an object to be selected in said plurality of scan lines.

12. The display apparatus according to claim 7, further comprising:

a reference current adjusting portion for adjusting the level of said reference current in accordance with a set value of data current corresponding to said display luminance.

13. The display apparatus according to claim 12, wherein said reference current adjusting portion selectively outputs one of a plurality of current levels prepared in advance, as said reference current.

14. The display apparatus according to claim 7, wherein each of said first and second current supply circuits further includes a switch portion provided between said current driving portion and said corresponding data line and turned on in said second operation mode, and in the ON period of said switch portion, the voltage of said input node is maintained at said predetermined initial voltage for a predetermined period and, after that, said input voltage is transmitted to said input node.

* * * * *